United States Patent [19]

Bevand

[11] Patent Number: 4,742,779

[45] Date of Patent: May 10, 1988

[54] BOGIE WITH SWIVELING AXLES

[75] Inventor: Jacques Bevand, Creusot, France

[73] Assignee: Creusot-Loire, Paris, France

[21] Appl. No.: 829,841

[22] Filed: Feb. 11, 1986

Related U.S. Application Data

[63] Continuation of Ser. No. 404,792, Aug. 3, 1982, abandoned.

[51] Int. Cl.[4] ..... B61F 5/38; B61F 3/02

[52] U.S. Cl. ..... 105/167; 105/218.1; 105/224.1; 267/3; 267/141.1

[58] Field of Search ..... 105/165, 167, 168, 182 R, 105/218 R, 218 A, 222, 223, 224 R, 224 A, 224.1, 182.1, 224.05, 224.06, 218.1, 218.2; 267/3, 6, 141.1, 153

[56] References Cited

U.S. PATENT DOCUMENTS

| | | | |
|---|---|---|---|
| 424,089 | 3/1890 | Bosdevex | 105/168 |
| 2,668,505 | 2/1954 | Janeway | 105/223 X |
| 4,170,179 | 10/1979 | Vogel | 105/218 A X |
| 4,278,029 | 7/1981 | Eggert, Jr. | 105/224.1 |
| 4,282,816 | 8/1981 | Harrison | 105/224.1 |
| 4,444,122 | 4/1984 | Dickhart, III | 105/224.1 |

FOREIGN PATENT DOCUMENTS

| | | | |
|---|---|---|---|
| 702126 | 1/1941 | Fed. Rep. of Germany | 105/218 A |
| 82849 | 9/1956 | Netherlands | 105/224.1 |
| 772644 | 5/1955 | United Kingdom | 105/224.05 |

*Primary Examiner*—Robert B. Reeves
*Assistant Examiner*—Donald T. Hajec
*Attorney, Agent, or Firm*—Rines and Rines, Shapiro and Shapiro

[57] ABSTRACT

A bogie with swiveling axles for pivotable mounting under the body of a rail vehicle of the metro or tram type having a bogie chassis (1) carried by two axles (2) provided with axle boxes (3) and capable of being swiveled by an articulated system moved by the rotation of the body, the chassis (1) being supported on each axle box via two resilient support elements (4, 8) at least partly constituted of elastomer and mounted above and below the box, a second articulated system (5) connecting two axle bones in such manner as to cause them to pivot about vertical axes of symmetry of the axles.

4 Claims, 1 Drawing Sheet

BOGIE WITH SWIVELING AXLES

This is a continuation application of U.S. Ser. No. 404,792, filed Aug. 3, 1982, now abandoned.

The present invention relates to a bogie with swiveling axles for mounting under th body of a rail vehicle of the metro or tram type, this bogie being of the motor or carrier kind.

Certain rail vehicles, such as metros and trams, follow curves of very small radii of curvature. Bogies the axles of which may be swiveled in such manner as to become convergent in curves are known. The swiveling of the axles limits the dynamic pull applied, transversely, on the wheel flanges. It limits stress and wear of the flanges, as well as the noise cuased by contact of the flanges with the rails.

The object of the present invention is a bogie provided with a mechanism for swiveling the axles which does not encumber the center of the bogie and in which the chassis rests on the axle boxes through resilient elements which, while permitting swiveling the axles and their return, assures the primary suspension. This arrangement makes it possible to assure effective suppression of the vibrations between the bogie chassis and the axle boxes, this advantage being especially noticeable in the low frequency range. The mechanism for swiveling the axles assures, in certain cases, the transmission of traction and braking forces between the axles and bogie chassis.

The bogie according to the invention is pivotably mounted under the body of a rail vehicle, and it comprises a bogie chassis carried by axles provided with axle boxes and capable of being swiveled by an articulated system moved by the relative rotation of the body. The chasis is supported on each axle box via two resilient support elements at least partly constituted of elastomer and mounted respectively above and below the axle box, a second articulated system connecting two axle boxes in such manner as to cause them to pivot about vertical axes of symmetry of the axles.

Each resilient support element is constituted by two elastomer blocks arranged in chevron form symmetrically with respect to a vertical plane perpendicular to the axis of the axle and centered on the vertical plane passing through this axis of the axle.

Each articulated system is composed of a control lever pivotably mounted on the chassis and articulated to two connecting bars each coupled through an articulation to an axle box.

The invention will now be described in more detail with reference to an embodiment given by way of example and illustrated in the accompanying drawings.

Figure 3:
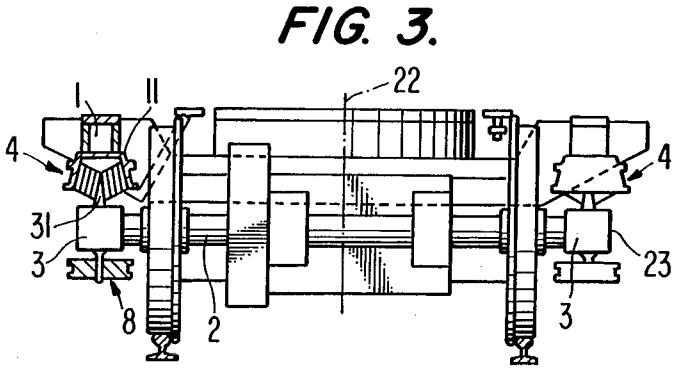
FIG. 3 shows a left-hand view, partly in section, along line III—III of FIG. 1.
Figure 5:
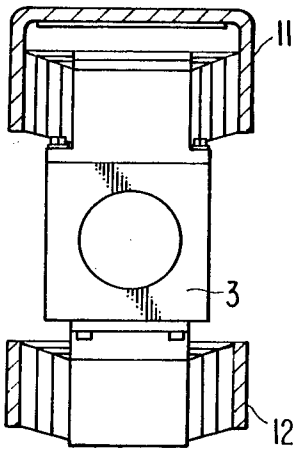
FIG. 5 is a section view, along line V—V of FIG. 4.
Figure 4:
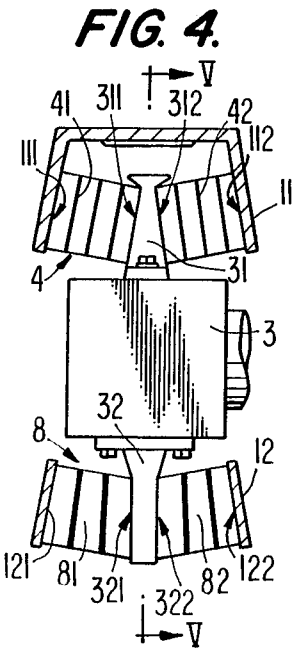
FIG. 4 is a detail view, along line IV—IV of FIG. 2, showing the resilient support elements.
Figure 2:
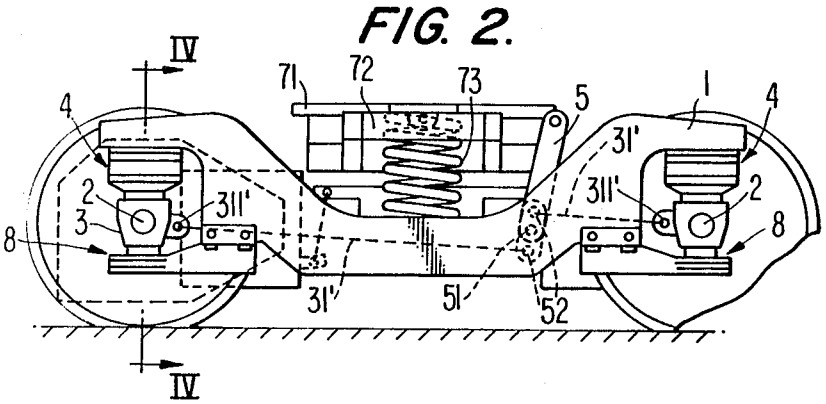
FIG. 2 shows an elevation view of the bogie of Figure 1.
Figure 1:
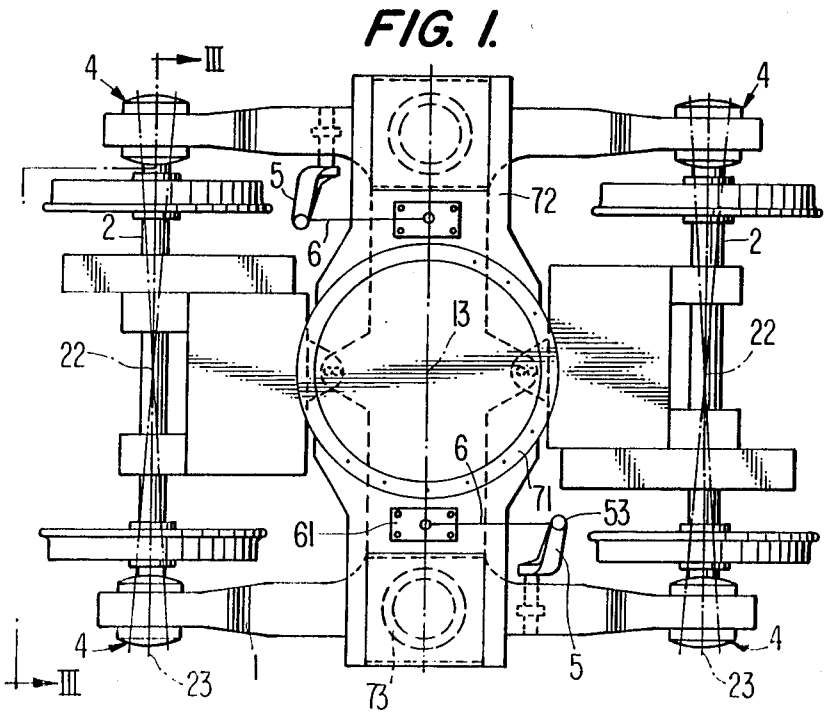
FIG. 1 shows a plane view of the bogie according to the invention.

With reference to FIGS. 1 to 5, the bogie comprises a bogie chassis 1 which is carried by two pairs of wheels connected by an axle 2. Each axle is equipped with two axle boxes 3. The vertical axis of symmetry and of swiveling of each axle, located at equal distances from the wheels, is numbered 2.

The body of the vehicle rests on the bogie via a pivoting ring 71 which is coaxial with the vertical central axis 13 of the bogie. This ring comprises two rings which can pivot relative to one another, by means of bearings, about the central axis 13, one of the rings being solid with the body, the other ring being soild with a cross member 72 which is supported at its ends on the bogie chassis via two springs 73 forming the secondary suspension.

The bogie chassis is connected to each axle box by two resilient support elements 4, 8 mounted one under the other in such manner that the one, 4, is located above the axle box, and the other, 8, is located underneath. Each support element 4 or 8 is arranged in such manner as to be symmetrical with respect to the vertical plane passing through the axis of revolution 23 of the axle, and with respect to a longitudinal plane perpendicular to the same axis.

The chassis of bogie 1 forms, on either side of each axle box, two branches supporting the resilient support elements 4 and 8.

Each resilient support element 4 or 8 is composed of two resilient blocks 41, 42 or 81, 82 at least partly made of elastomer and each mounted between a support face 311, 312 or 321, 322 of an inner seating 31 or 32 solid with the axle box, and a support face 111, 112 or 121, 122 of an outer seating 11 or 12 solid with the chassis. These support faces are inclined so as to form V's with respect to a longitudinal plane which is perpendicular to the axis of revolution 23 of the axle. Support faces 111, 112 or 121, 122 are symmetrical with respect to this longitudinal plane, just as are support faces 311, 312 or 321, 322. The blocks of a given support element are arranged so as to form a chevron truncated symmetrically with respect to the just mentioned longitudinal plane. The imaginary intersections of support faces 111, 112 or 121, 122 and 311, 312 or 321, 322 are horizontal and contained in the plane of symmetry which is perpendicular to the axis of revolution 23 of the axle. The centers of blocks 41, 42 and 81, 82 are centered in the vertical plane passing through 23. This V- or chevron arrangement assures radial or transverse guidance or, while permitting swiveling about axis 22. Each resilient block 41 or 42 has a monobloc or laminated type sandwich structure which is made of elastomer plates separated by intermediate metal plates, these plates, alternatively arranged, being adhered together.

On the upper resilient element 4 the blocks are so arranged as to leave a space between the outer seating 11 and the inner seating 31. An abutment of elastomer is adhered to seating 11 on the side of seating 31. This abutment assures the limitation of vertical deflections of the two seatings with respect to one another.

Each element further comprises abutments limiting the rotational deflection of the axle about axis 22.

The swiveling of the axles is controlled by two articulated systems each connecting two axle boxes 3 located on the same side of the median longitudinal plane of the bogie. Each articulated system causes the two associated axle boxes to rotate angularly in opposite directions about the axes of symmetry. At curves, one of the axles undergoes a rotation in clockwise direction, while the other axle undergoes a rotation in counterclockwise direction, the axles thereby becoming convergent. The two articulated systems impose equal and opposite displacements on the two axle boxes 3 located on the same side of the longitudinal axis of the bogie, and impose equal and opposite displacements on the two axle boxes 3 of a given axle.

Each articulated system comprises a control lever 5 which is articulated about an axis 51 on the chassis of bogie 1. The two levers 5 are mounted on each side of the median vertical plane passing through the axes 22.

Each lever 5 is connected to two axle boxes 3 by connecting bars 31'. Each connecting bar 31' is attached to an axle box 3 by an articulation 311' located in the horizontal plane passing through the axes of the axle and by an articulation 52 to a lever 5.

The pivoting movement of each control lever 5 about its axis 51 is controlled by the pivoting movement of the body about central axis 13. The body comprises two points of movement 61 which describe a circle, about central axis 13, when the body pivots. Each point of movement 61 of the body is coupled to a point of movement 53 of a control lever 5 via a connection which permits vertical body/bogie chassis deflections and allows rotations of the body and of the control lever about their respective axes of rotation. Each connection coupling a point of movement 61 of the body and a point of movement 53 of the control lever is constituted by a tie rod 6, the points of movement 61 and 53 being swivel joint articulations which permit the vertical deflections with respect to the body and the bogie.

Each control lever 5 oscillates about a substantially horizontal axis 51, in a substantially vertical plane. The points of movement 61 and 53 and the tie rods 6 are thus positioned substantially at the level of the pivoting ring and at a short distance from the body. Because of springs 73 of the secondary suspension, the control levers 5 are shifted from the transverse plane passing through axis 13, the bars 31' thereby having unequal lengths.

The motor bogie which is illustrated in the drawings comprises two motors 9 which are suspended on the chassis and each drive an axle.

The operation of the bogie will now be explained.

In a straight line, the parallelism of the two axles is given by the resilient elements 4 and 8 by the control levers 5 which are coupled to the body. The first axle 2 arriving at a curve is given a lateral pull originating from the outer rail which orients the bogie according to the position perpendicular to the longitudinal axis of the track. In the course of the rotation, resilient elements 4 and 8 are subjected, in the longitudinal plane, to displacements which depend on the radius of the curve traversed by the bogie. The resilient blocks are precompressed and worked in shear. The structure of the resilient elements 4 and 8 allows angular pivoting of each axle about its vertical axis 22, while assuring transverse guidance with the respect to the bogie chassis. In entering the curve, the bogie assumes the normal position on the track, which automatically involves a relative rotation of the bogie chassis with respect to the body. This rotation is translated by a rotation of the points of movement 61 about axis 13, with respect to the bogie. This rotation of the points of movement 61 causes the pivoting of the control levers 5 about their axes 51, which leads to the relative drawing together of the axle boxes 3 located on the side of the inner rail, and the relative drawing apart of the axle boxes 3 located on the side of the outer rail. The axes of the axles converge toward the interior of the curve.

The rotation of the body with respect to the first bogie which is engaged with the curve also implies a rotation of the body with respect to the succeeding bogie. The relative rotation controls the levers 5 of the succeeding bogie, and consequently the orientation of the axles of this bogie. The problem of entry into the curve is facilitated by the fact that the transition between the straight line and the circular portion of the track is effected by the intermediary of a parabolic portion.

At the exit from the cruve, the resilient elements 4 and 8 exercise a restoring force which tends to reposition the axle in transverse position. The rotation of the body towards its original position along the longitudinal axes of the bogie returns the control levers 5 towards their original positions.

The traction or braking stress between the axles and bogie chassis is transmitted, via bars 31', to the control levers 5 which are connected to the bogie chassis by articulations 51. The traction or braking stress applied to the bogie chassis is transmitted to the body through the intermediary of the pivoting ring. The articulated systems are provided in order to support simultaneously the traction or braking stresses and the orientation stresses of the axles. In a curve, the orientation stresses of the axles in the orientation mechanism enter into play, in addition to the eventual traction or braking stresses. At this moment, the orientation stresses arise in proportion to the angles through which the axles have pivoted.

The first car which enters into the curve pulls along, because of its coupling, the second car, while progressively swiveling its first and its second bogie, and so on in sequence.

It will be understood that the bogie could comprise three axles, the median axle being guided about an axis which is fixed with respect to the bogie chassis, and the two outer axles being oriented as in the embodiments described hereinabove.

The upper and lower resilient elements 4 and 8 can be made of resilient blocks of different or identical compositions and dimensions.

The bogie chassis could comprise closed frames each surrounding an axle box and serving as support for elements 4 and 8.

The axle boxes, instead of being located at the exterior of the wheels, could be located between the wheels, the side frames of the bogie chassis then extending between the wheels.

I claim:

1. A bogie comprising a bogie frame pivotally mounted under a body of a rail vehicle, pairs of wheels with each pair having an axle provided with axle boxes adjacent to respective ends of the axle, each of said axle boxes being supported by two resilient support elements, one of which is mounted above and the other below the axle box substantially aligned in a vertical plane containing an axis of an associated axle, each support element being symmetrical in said vertical plane and also in a vertical plane perpendicular to the axis of the associated axle, each support element comprising interleaved plural elastomer and plural metal layers that form a chevron shape in a cross section of the support element in said vertical plane, each support element having means connecting the same to the bogie frame and to one of said axle boxes so as to provide stabilized limited movement of said axle boxes relative to said bogie frame both longitudinally and transversely of said bogie frame, and first and second articulated systems moved by relative rotation of said vehicle body and said bogie frame, each system connecting two axle boxes at a respective side of the bogie frame in such manner as to cause those axle boxes to pivot about vertical axes of symmetry of associated axles and thereby to stress the elastomer of the associated support elements, and each system transmitting traction and braking stress between said axles and said bogie frame.

2. A bogie according to claim 1, wherein each articulated system comprises a control lever pivotally mounted on the bogie frame and articulated to two connecting bars each coupled through an articulation to an axle box.

3. A bogie according to claim 2, wherein each of said levers is coupled to a point of movement of the vehicle body via a connection permitting vertical body to bogie frame deflections and enabling rotations of said body and said levers about their respective axes or rotation.

4. A bogie according to claim 3, wherein said connection is constituted by a tie rod connected by a swivel joint articulation to the control lever and to the point of movement of the body.

* * * * *